United States Patent [19]

Skillman

[11] 3,957,180

[45] May 18, 1976

[54] POUR SPOUT

[76] Inventor: Jack J. Skillman, 727 E. 60th Street, Chicago, Ill. 60637

[22] Filed: Aug. 6, 1975

[21] Appl. No.: 602,297

[52] U.S. Cl. ..... 222/528; 229/7 R
[51] Int. Cl.[2] ..... B67D 5/00
[58] Field of Search..... 222/528, 527; 229/17 R, 229/7 R

[56] References Cited

UNITED STATES PATENTS 2,323,505 7/1943 Wilcox ..... 229/7 R
3,421,680 1/1969 Cohee ..... 229/17 R

FOREIGN PATENTS OR APPLICATIONS 2,100,937 7/1972 Germany ..... 222/528

*Primary Examiner*—Allen N. Knowles
*Assistant Examiner*—Hadd S. Lane
*Attorney, Agent, or Firm*—Laff, Whitesel & Rockman

[57] ABSTRACT

A boxlike container has a pour spout top. The spout is located in the center of one side and has a shape which may be opened by squeezing the box corners. The spout may be closed by pushing it shut, with pressure against two pressure points.

12 Claims, 9 Drawing Figures

POUR SPOUT

This invention relates to a container or carton having a pour spout which facilitates the pouring of material from the carton and more particularly to such cartons which fold to a flat top so that they may be stacked, one on top of another.

Cartons with the inventive pour spout may be used as dispenser packs for most fluid materials, (i.e., liquids, granules, flakes, etc.) and for such varied products as milk, syrups, spices, condiments, toiletries and lubricating oils, to name but a few. Perhaps the most familiar carton of this type is a milk carton.

The flat pour top carton enables easy stacking and efficient packing of the cartons. The carton is designed so that the entire structure may be formed from a single substantially rectangular paperboard blank with virtually no waste material. Thus, the structure does not require additional parts or assembly operations for providing the pour spout.

Pour top milk cartons, commonly formed from a single blank of paperboard material, usually have a top with a peaked pouring spout. This type of structure is very widly used, but the pour spout makes a structure which is not stackable and is inefficient in utilization of space.

Accordingly, an object of this invention to provide a flat-top stackable carton having a novel and effective pouring spout. Here, an object is to provide a spout which may be opened and reclosed to a flat topped position which enables the carton to be stacked.

Yet another object of the invention is to provide a structure which eliminates the deficiencies of the prior art, provides an efficient utilization of space, enables accurate pouring, and may be formed from a single substantially rectangular blank of paperboard or other material such as molded plastic, with virtually no waste of blank material.

In keeping with an aspect of the invention, these and other objects are provided by utilization of a cardboard blank having a pair of unique diamond patterns of triangular score lines centered upon a generally rectangular area near the center of one top side edge of the box. When opposed corners are squeezed together, the box tends to fold along the score lines and thereby force the rectangular area outwardly from the edge, to form a pour spout. Merely by applying localized pressure at predetermined points on the carton, the spout may be made to open or close. When molded in plastic, the box is formed in its final configuration with molded-in score lines. Any suitable form of molding may be used, such as blow molding, for example.

A preferred embodiment of the invention will become more apparent from a study of the attached drawings, wherein.

Figure 1:
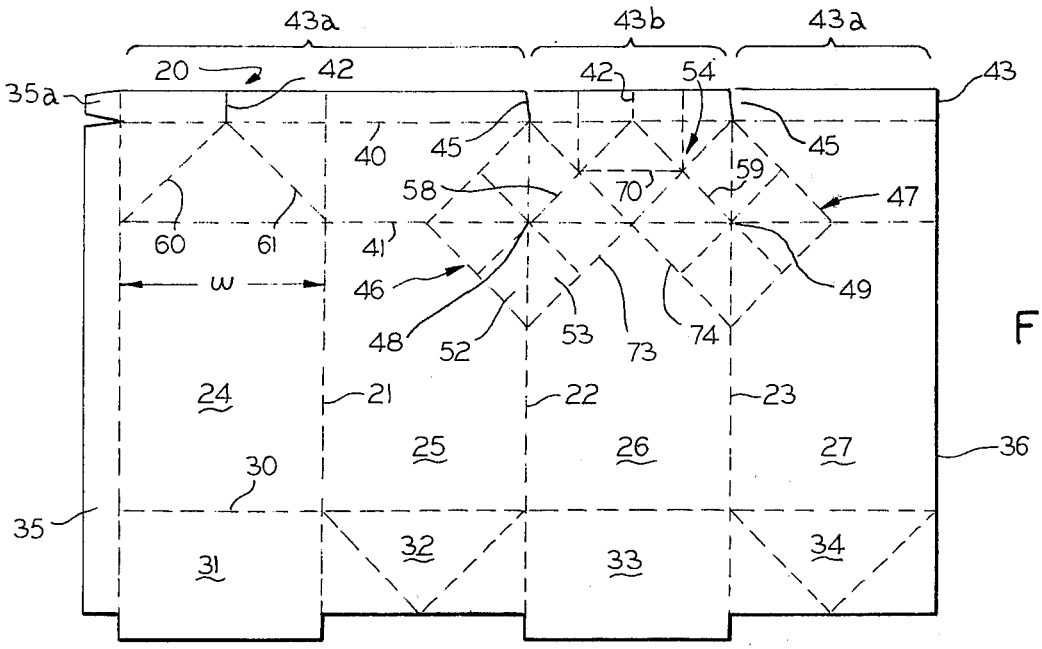
FIG. 1 is a plan view of a paperboard blank which may be folded and glued in order to form the inventive carton.

A rectangular paperboard blank 20 is scored along three vertical lines 21, 22, 23 to form four panels 24–27. A horizontal line 30 is scored along the bottom to form four bottom panels or flaps 31–34 that may be folded inwardly. Glue flap 35 is formed on one end of the blank 20.

Thus, to form a rectangular tube, it is only necessary to fold the blank 20 along each of the score lines 21–23, to glue flap 35 in an overlapping position to edge 36, to fold in the bottom panels 31–34 and to glue the panels 31, 33 over the panels 32, 34.

A pair of horizontal score lines 40, 41 are formed orthogonally with score lines 21, 22, 23. Lines 40, 41 are positioned adjacent the top of the blank 20 so that the rectangular top may fold to form carton shoulders along line 41. Opposite ends of glue or other connecting flaps 43 are joined together (see FIG. 2). The glue or connecting flap 43 folds along lines 42, 42, and is cut or torn along lines 45, 45 just prior to opening the carton. Suitable glue or other joining material is spread or otherwise formed along the glue flap 43 so that the edges may be permanently joined together along length **43*a* and releasably joined along length 43*b* (i.e., between lines 45, 45). The glue or other joining material in area 43*a* is adequate to permanently secure the edges together, and to release in area 43*b*, under pressure, so that the spout may be opened. When the carton is molded from plastic, the flap 43** will be joined by electro-welding, special molding techniques, or the like.

Figure 9:
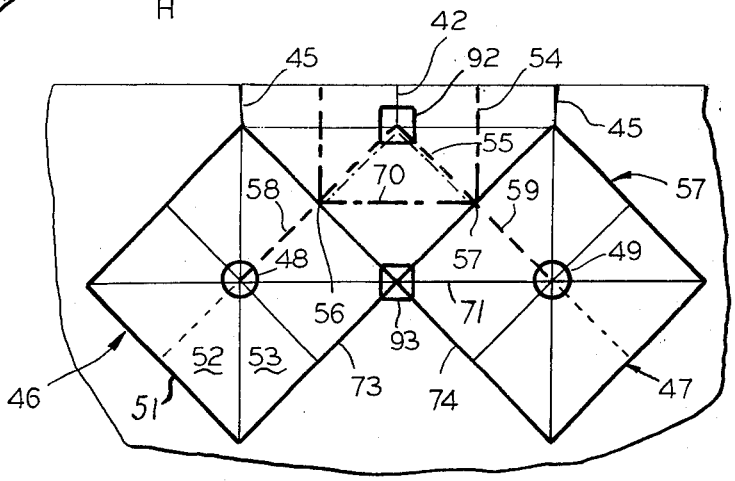
FIG. 9 is a fragment, of FIG. 1, showing the pressure points used to open and close the carton.

Two diamond-shaped fields 46, 47 of opposed triangular score lines are formed on each of two adjacent corners 48, 49 of the carton blank 20. For easy identification, one of the diamonds is outlined in heavily linked lines 51 (FIG. 9). An exemplary two of the opposed triangles are numbered 52, 53. From an inspection of FIG. 1, it is clear that there are a total of two such diamonds formed from 16 opposed triangles.

In the center of the two fields of diamonds and on spout panel 26, there is a spout formed from a rectangular pattern of score lines, nested among the triangular patterns. The rectangular pattern is outlined by heavily inked dot-dashed lines 54 (FIG. 9). The bottom line of the rectangular pattern 54 forms the base of a small isosceles triangle 55 (shown by lightly inked double dot-dashed lines) having its apex at the glue flap fold line 42. The corners 56, 57 of the rectangular pattern 54 engage the center point on opposed edges of the two diamond patterns 46, 47, and bisect the legs of a large isoceles triangle defined by heavily inked dashed lines 58, 59. These large and small isosceles triangles are congruent, with a common apex and parallel bases.

On the side panel 24, opposite the spout panel 26, a pair of score lines 60, 61 form a second large isosceles triangle having the carton shoulder line 41 as a base, the width w of the base being equal to the width of the side panel 24. Score lines 60, 61 are substantially identical to score lines 58, 59 which form the first mentioned large isosceles triangle on spout panel 26.

After the carton blank (FIG. 1) is folded along lines 21–23 and flap 35 is glued to edge 36, a rectangular tube is formed. Bottom panels 32, 34 are folded in; then panels 31, 33 are folded over, tucked together and glued in place. Next, the top glue flap 43 is folded along crease lines 42, 42, brought together, pressed flat and glued together to form a continuous band, with the crease line forming at the apex of the congruent isosceles triangles. So that the top may be thus formed, the carton creases along the lines 58–61 of the two large isosceles triangles, having there respective base lines formed by the carton's shoulder line 41. The folding along crease lines 58–61 causes the two large isosceles triangular panels to project outwardly away from the rectangular tubing side panels 24, 26 (FIG. 2). The base 70 of the smaller congruent triangle is also a base line in the rectangular pattern 54. The base 71 of the larger congruent triangle is one of the upper shoulder or top edges of the parallelepiped carton.

The glue flap 43 may be rotated, as indicated by arrow A, to lie flat upon the tops of the triangular panels. Then, downward pressure (arrows B, C) may be applied upon the apex ends of the projecting triangular panels. This causes the triangular panels to fold down and lie flat, in face-to-face relationship, against panels 24, 26, as shown in FIG. 3.

Figure 3:
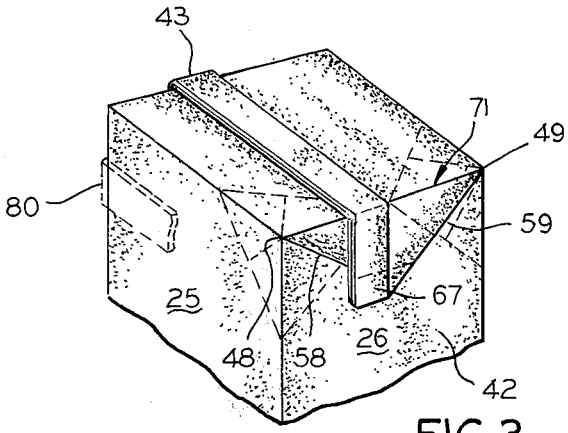
FIG. 3 is a view similar to FIG. 2 showing the final form of the carton with a flat top and sealed spout.

The carton thus becomes a rectangular parallelepiped when it is folded into the position shown in FIG. 3, and the triangular flaps are secured into position, in any suitable manner. For example, releasable adhesive may be used to hold the flaps down and to prevent an accidental opening of the spout. It should be apparent that the carton is thus formed into a rectangular parallelepiped which may be easily packed into a box, stacked, or otherwise handled.

Figure 4:
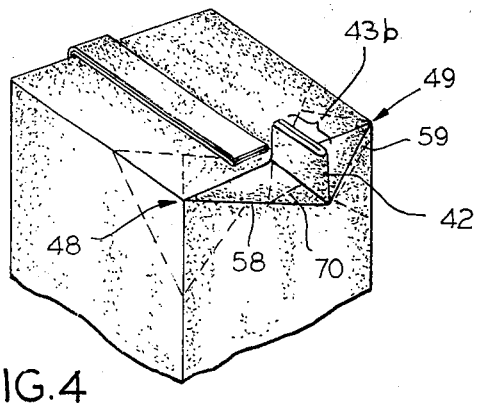
FIG. 4 is a view similar to that of FIG. 2 showing the next unfolding step with the spout lifted to an open position.

To open the spout, a fingernail is caught under the end 67 and the triangular panel defined by crease lines 58, 59 is pulled upwardly and to the position shown in FIG. 4. As the triangular flap lifts, a stress is placed upon the releasable adhesive holding together the two sides of the glue flap 43, in area **43*b* adjacent the fold line 42. Thus, the flap 43 tends to open in the area 43*b***, preliminary to the formation of a spout.

Figure 2:
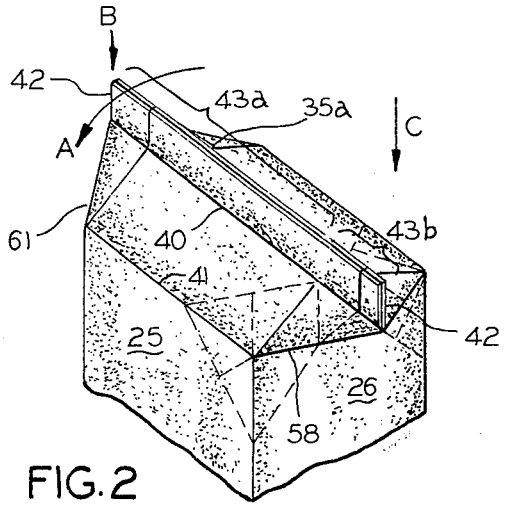
FIG. 2 is a perspective view of a container made from the blank of FIG. 1, in the next to final step of folding process.
Figure 5:
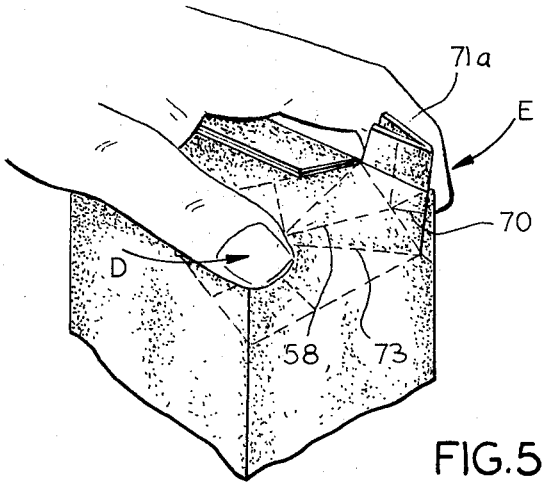
FIG. 5 is a view similar to that of FIG. 2 showing the next unfolding step with the spout being opened responsive to opposed pressures on opposite corners of the carton.
Figure 8:
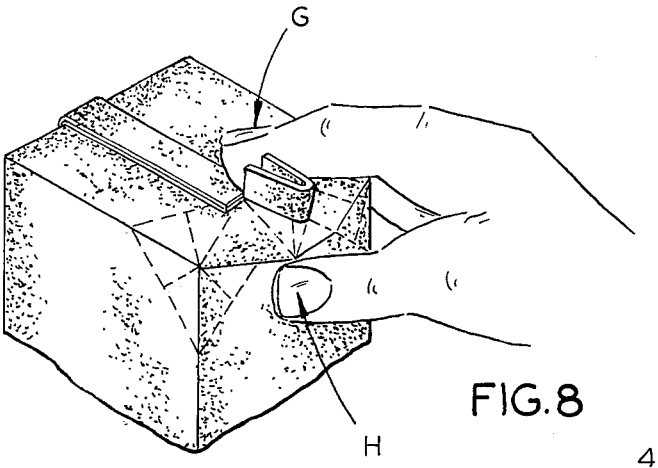
FIG. 8 is a similar view which shows how the spout may be returned to a closed position responsive to opposed pressures on it.

FIG. 9 includes a fragment of the blank of FIG. 1 showing the two diamond patterns 46, 47 of crease lines. To open the spout (as shown at FIG. 5), pressure is applied simultaneously at the points marked by circles 48, 49 (FIG. 9). To close the spout (as shown in FIG. 8), pressure is applied simultaneously at the points marked by squares 92, 93 (FIG. 9). By inspection of FIG. 9, it should be apparent that circles 48, 49 are at the centers of the two diamond shaped symmetrical crease line patterns 46, 47, outlined by heavily linked lines. The squares 92, 93 are at the center of the rectangular pattern outlined by heavily inked dot-dashed lines and at the junction point of the patterns 46, 47.

Figure 6:
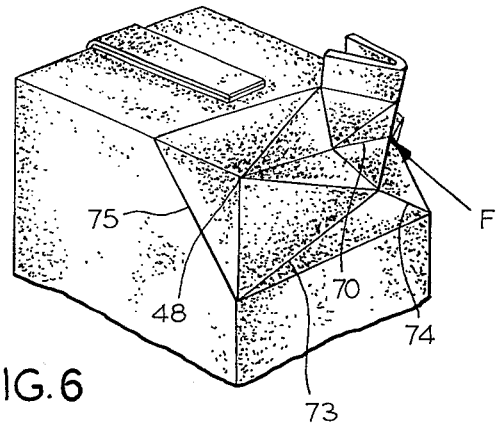
FIG. 6 is a similar view showing the spout being opened to form the pouring opening responsive to pressure locally applied to the front of the spout.

In greater detail, to open the spout the adjacent corners 48, 49 (marked by circles in FIG. 9) of the carton are squeezed together, as indicated by the arrows D, E (FIG. 5). When this occurs, the carton folds along the various crease lines. The small triangular panels, in the two diamond patterns 46, 47 tend to cave in toward the interior of the carton and to fold, relative to each other, along their crease lines to form a series of facets leading to the spout area. This localized folding tends to better separate the glue flaps 43 into the pouring spout area **71*a*. At this time, the spout begins to project outwardly along the crease lines 73, 74 (FIG. 6). The adjacent shoulder of the carton has become somewhat concave about the point 48, and the adjacent edge 75** taken on a somewhat sloping roof contour.

Figure 7:
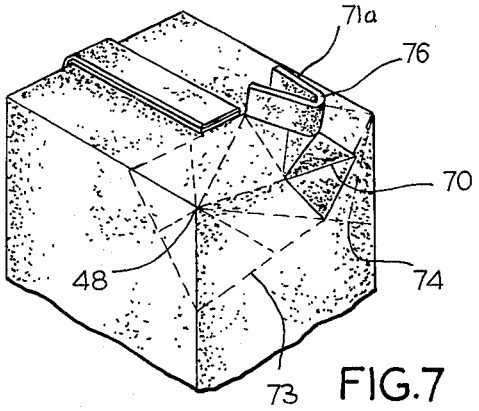
FIG. 7 is a similar view which shows the pouring spout standing in an open position.

To further project, extend, and form the spout area **71*a* into its final pouring configuration pressure is applied to the bottom crease line 70 of the rectangular pattern, as indicated by the arrow F. This pressure causes the base of the small isosceles triangle to snap back and the apex to snap out thereby spreading the spout opening 71*a* into its final pouring position, as seen in FIG. 7. There is a generally straight sharp edge along the front lip 76 of the spout, to form a non-drip pouring edge. A slightly outward bend along crease line 70** moves the pouring lip out beyond the side of the carton.

To close the spout after the pouring is complete, the spout is pinched together by pressure applied in the directions of the arrows G, H (FIG. 8). Applied at points 92, 93, which are marked by small squares in FIG. 9. This retraces — in inverse order — the folding sequence of FIGS. 7, 6.

Responsive to the pressures G, H, the spout is flattened, and returned to the form somewhat as shown on FIG. 2. At this time, rotation of the glue flap **43*b* and pressure in direction C causes the spout to be returned to the closed position of FIG. 3**.

According to the invention, a separate cap or band may be provided to slip on or off over the top of the carton in order to hold the end flaps in place. This band (symbolically shown at 80) is particularly useful for resealing the carton, after it has been opened.

For convenience of description, the foregoing description has referred to milk cartons, boxes, parallelepiped, and the like. However, it should be understood that the invention has utility wherever a spout may be required on a generally square or rectangular section. For example, it is quite conceivable that a jug-shaped device may be made with a square top. Therefore, the term "parallelepiped" is used in this specification and in the claims to describe the spout on a generally square or rectangular section and, specifically, is not to be limited to any particular prismatic form. Quite the contrary, the parallel piped section may be incorporated into any suitable geometric form.

Those who are skilled in the art will readily perceive how further modifications may be made in the blank of FIG. 1 or to any other form thereof (such as a molded plastic box or jug) without departing from the scope and the spirit of the invention. Therefore, the appended claims are to be construed broadly enough to cover all equivalent structures.

I claim:

1. A pour spout for a square or rectangular top on a container made from a blank comprising a pair of diamond patterns of score lines centered on adjacent corners, with a rectangular pattern of lines nested between said diamond patterns, said container having a connecting flap along the perimeter of the top with a releasable area centered in said rectangular pattern.

2. The container spout of claim 1 wherein said diamond pattern includes a pair of fold lines forming a pair of congruent isosceles triangles having spaced parallel bases with a common apex, one of said bases being a line in the rectangular pattern and another of said bases being one of the upper or top edges of a parallelepiped formed on said container, the common apex of the congruent triangles terminating at said flap.

3. The container spout of claim 1 wherein said diamond patterns comprise a plurality of opposed triangles of score lines which move to facet positions when said adjacent corners are squeezed, said facet positions forcing said rectangular pattern into an extended pouring spout position.

4. The container spout of claim 1 wherein said blank is a paperboard which has a plurality of spaced parallel score lines which fold to form four panels into a rectangular tube, the upper ends of an opposed pair of said panels having crease lines forming a pair of large isosceles triangles one of which triangles is in the pair of diamond patterns, each triangle having a base which forms the upper edge of a parallelepiped on the panel on which said large isoceles triangle is formed, said flap forming a continuous band having a crease at the apex of each large isosceles triangle.

5. The container spout of claim 1 wherein said blank is a molded plastic container.

6. A paperboard blank for a parallelepiped carton, said blank comprising a rectangular blank of paperboard having at least three spaced parallel vertical score lines defining four panels which form a rectangular tube when the blank is folded along the crease lines, a pair of upper parallel crease lines running across the blank perpendicular to said vertical lines, the upper one of the pair of crease lines defining a glue flap, the lower one of the pair of crease lines defining the upper shoulders of the parallelepiped carton, two pair of score lines angularly formed on the blank between said pair of upper crease lines, one of said pair of angular lines forming one large isosceles triangle on one of said panels and the other of said pair of angular lines forming another large isosceles triangle on the panel which is opposite said one panel when said blank is folded and formed into said parallelepiped carton, when the rectangular tube is completed, the glue flap being joined together to form an unbroken band having crease lines at the apex of each of said large isosceles triangles, rectangular crease lines for forming a pouring spout being located at least in part in said one isosceles triangle, said unbroken band being shaped and dimensioned to fold over and be pressed downwardly with the opposed isosceles triangles folding outwardly and then down into a closed position over the outsides of said one and other panels, respectively and thereafter lifted to open a pour spout formed by folds at said rectangular crease lines.

7. The paperboard blank of claim 6 wherein the corners of said rectangular crease lines bisect the sides of said one isosceles triangle and one side of said rectangular crease lines forms a base of an isosceles triangle which is congruent and smaller than said one large triangle on said one panel.

8. The paperboard blank of claim 7 wherein two patterns of crease lines with a common junction point are formed symmetrically about said one large isosceles triangle, said pattern of crease lines being formed and dimensioned about a center point so that said rectangular crease lines are projected outwardly to form a pouring spout when pressure is applied simultaneously to the centers of said two patterns and retracted into said closed pressure when pressure is applied simultaneously to the center of said rectangular crease line and to the junction point of said two patterns.

9. A process of forming a container spout comprising the steps of:

a. forming crease lines for enabling at least one end of said container to be formed into at least a section of a rectangular parallelepiped, there being at least two adjacent intersections of said orthogonal lines which intersections form adjacent corners of the parallelepiped section, b. forming two patterns of crease lines both above and below, and surrounding said adjacent corners, said patterns being shaped and proportioned to extend a spout when the adjacent corners are squeezed together, and c. forming pour spout crease lines between said adjacent corners, said pour spout crease lines being shaped and proportioned to retract the spout when pressure is applied above and below it.

10. The process of claim 9 and the added step of molding said container in plastic.

11. A process of forming a container spout comprising the steps of:

a. forming crease lines for enabling at least one end of said container to be formed into at least a section of a rectangular parallelpiped, there being at least two adjacent intersections of said orthogonal lines which intersections form adjacent corners of the parallelepiped section, b. forming two patterns of crease lines about said adjacent corners, said patterns being shaped and proportioned to extend a spout when the adjacent corners are squeezed together, and of forming two diamond patterns of opposed triangles, respectively centered on said adjacent corners, the pattern centers forming the squeeze points, and c. forming pour spout crease lines between said adjacent corners, said pour spout crease lines being shaped and proportioned to retract the spout when pressure is applied above and below it.

12. A process of forming a container spout comprising the steps of;

a. forming crease lines for enabling at least one end of said container to be formed into at least a section of a rectangular parallelepiped, there being at least two adjacent intersections of said orthogonal lines which intersections form adjacent corners of the parallelepiped section, b. forming two patterns of diamond-shaped crease lines about said adjacent corners, said patterns being shaped and proportioned to extend a spout when the adjacent corners are squeezed together, and c. forming pour spout crease lines between said adjacent corners, said pour spout crease lines being shaped and proportioned to retract the spout when pressure is applied about and below it, and of forming rectangular crease lines around the spout area and forming points for applying said pressure in the center of the rectangular area and at a midpoint between the diamond patterns.

* * * * *

UNITED STATES PATENT AND TRADEMARK OFFICE

CERTIFICATE OF CORRECTION

PATENT NO. : 3,957,180

DATED : May 18, 1976

INVENTOR(S) : Jack J. Skillman

It is certified that error appears in the above-identified patent and that said Letters Patent are hereby corrected as shown below:

Col. 2, line 50, change "linked" to --inked--;

Col. 3, line 37, after "example," insert --a--;

Col. 3, line 60, change "linked" to --inked--;

Col. 4, line 50, change "parallel piped" to --parallelepiped--;

Col. 6, line 60 change "about" to --above--.

Signed and Sealed this

Seventh Day of September 1976

[SEAL]

*Attest:*

RUTH C. MASON
*Attesting Officer*

C. MARSHALL DANN
*Commissioner of Patents and Trademarks*